US010239648B2

(12) United States Patent
Lord et al.

(10) Patent No.: US 10,239,648 B2
(45) Date of Patent: Mar. 26, 2019

(54) APPARATUS AND METHOD FOR FORMING A CUP WITH A REFORMED BOTTOM

(71) Applicant: Ball Metalpack, LLC, Westminster, CO (US)

(72) Inventors: Richard L. Lord, Westminster, CO (US); Jason M. Kaanta, Pine, CO (US); Christine N. Buckler, Broomfield, CO (US); Joseph D. Bulso, Canton, OH (US); William J. Simmons, Canton, OH (US)

(73) Assignee: Ball Metalpack, LLC, Westminster, CO (US)

( * ) Notice: Subject to any disclaimer, the term of this patent is extended or adjusted under 35 U.S.C. 154(b) by 463 days.

(21) Appl. No.: 14/925,477

(22) Filed: Oct. 28, 2015

(65) Prior Publication Data

US 2016/0114371 A1 Apr. 28, 2016

Related U.S. Application Data

(60) Provisional application No. 62/069,623, filed on Oct. 28, 2014.

(51) Int. Cl.
*B21D 22/24* (2006.01)
*B21D 22/28* (2006.01)
(Continued)

(52) U.S. Cl.
CPC ..... *B65D 1/40* (2013.01); *B21D 22/24* (2013.01); *B21D 22/28* (2013.01); *B21D 51/26* (2013.01); *B65D 1/16* (2013.01)

(58) Field of Classification Search
CPC ..... B21D 22/24; B21D 22/28; B21D 24/005; B21D 51/26
(Continued)

(56) References Cited

U.S. PATENT DOCUMENTS 242,472 A 6/1881 Newton
452,713 A 5/1891 Lewis
(Continued)

FOREIGN PATENT DOCUMENTS

AU 2012244852 10/2012
CA 2348438 3/2001
(Continued)

OTHER PUBLICATIONS

"Inside a Ball Beverage Can Plant," Ball, Sep. 2002, 1 page [retrieved online from: www.ball.com/Ball/media/Ball/Global/Downloads/How_a_Ball_Metal_Beverage_Can_Is_Made.pdf?ext=.pdf].
(Continued)

*Primary Examiner* — Teresa M Ekiert
*Assistant Examiner* — Gregory D Swiatocha
(74) *Attorney, Agent, or Firm* — Brown Rudnick LLP; Robert J. Tosti

(57) ABSTRACT

An apparatus and method of forming a metallic cup that is subsequently reformed into a container body. More specifically, an apparatus and methods used to form a metallic cup with a reformed bottom having an inwardly oriented projection are disclosed. The inwardly oriented projection reduces a height of the metallic cup but utilizes the same amount of metallic stock material as a taller cup with substantially the same diameter that does not have an inward projection. The inwardly oriented projection thus allows the use of a conventional bodymaker and other can manufacturing tools to convert the cup into a container body of a preferred size and shape.

5 Claims, 7 Drawing Sheets

(51) Int. Cl.
*B21D 51/26* (2006.01)
*B65D 1/40* (2006.01)
*B65D 1/16* (2006.01)

(58) Field of Classification Search
USPC ..... 72/347–349
See application file for complete search history.

(56) References Cited

U.S. PATENT DOCUMENTS 1,698,999 A 1/1929 Hothersall
2,189,004 A 2/1940 Harwood
2,337,182 A 12/1943 Calleson et al.
2,339,763 A 1/1944 Calleson et al.
2,359,775 A 10/1944 McManus et al.
2,426,550 A 8/1947 Coyle
D195,103 S 4/1963 Houghton
D198,342 S 6/1964 Taylor et al.
D200,362 S 2/1965 Nelson et al.
D209,480 S 12/1967 Wallace
3,494,169 A 2/1970 Saunders
3,508,427 A 4/1970 Broderick
D217,585 S 5/1970 Lambelet
D217,847 S 6/1970 Jenkins et al.
3,690,507 A 9/1972 Gailus et al.
D225,210 S 11/1972 Becker
D225,835 S 1/1973 Johnson et al.
D226,370 S 2/1973 Cromb
3,726,244 A 4/1973 Arangelovich et al.
3,733,881 A 5/1973 Grigorenko
3,738,540 A 6/1973 Morane
D228,625 S 10/1973 Pearce
3,786,957 A 1/1974 Hilgenbrink
D232,915 S 9/1974 Becker
3,964,413 A 6/1976 Saunders
3,972,217 A 8/1976 Misonoo
3,995,572 A 12/1976 Saunders
4,095,544 A 6/1978 Peters et al.
4,116,361 A 9/1978 Stargell
D256,776 S 9/1980 Monnet
4,261,193 A 4/1981 Boik
4,281,769 A 8/1981 Ignell
4,386,514 A 6/1983 Herten
4,416,388 A 11/1983 Mulawski
4,433,791 A 2/1984 Mulawski
4,442,692 A 4/1984 Lyu
4,485,663 A 12/1984 Gold et al.
4,513,874 A 4/1985 Mulawski
4,527,412 A 7/1985 Stoffel et al.
4,571,978 A 2/1986 Taube et al.
4,580,690 A 4/1986 Mulawski
4,587,825 A * 5/1986 Bulso, Jr. ..... B21D 51/44 413/56
4,734,303 A 3/1988 Fujiwara et al.
4,753,364 A 6/1988 Stoffel et al.
4,774,839 A 10/1988 Caleffi et al.
4,796,454 A 1/1989 Bulso, Jr. et al.
4,863,333 A 9/1989 Kaminski
D307,648 S 5/1990 Arrington
4,962,659 A 10/1990 Imazu et al.
4,984,708 A 1/1991 Imazu et al.
5,014,536 A 5/1991 Saunders et al.
5,024,077 A * 6/1991 Bulso, Jr. ..... B21D 22/24 413/1
D325,697 S 4/1992 Parr
5,105,645 A 4/1992 Kobayashi et al.
5,111,679 A 5/1992 Kobayashi et al.
5,138,858 A 8/1992 Johnson et al.
5,168,742 A 12/1992 Heyes et al.
5,209,099 A 5/1993 Saunders
5,249,447 A 10/1993 Aizawa et al.
5,297,414 A 3/1994 Sainz
5,343,729 A 9/1994 Saunders
5,347,839 A 9/1994 Saunders
5,355,710 A 10/1994 Dickhoff
D352,004 S 11/1994 Bikoff et al.
5,388,716 A 2/1995 Stoffel et al.
5,394,727 A 3/1995 Diekhoff et al.
5,409,130 A 4/1995 Saunders
5,433,099 A 7/1995 Katsuhiro et al.
5,487,295 A 1/1996 Diekhoff et al.
5,497,900 A 3/1996 Caleffi et al.
D369,294 S 4/1996 Hirato
5,522,248 A 6/1996 Diekhoff et al.
5,544,517 A 8/1996 Shimizu
5,555,992 A 9/1996 Sedgeley
5,557,963 A 9/1996 Diekhoff
5,572,893 A 11/1996 Goda et al.
D378,016 S 2/1997 Armbruster et al.
5,622,070 A 4/1997 Bulso, Jr.
D381,575 S 7/1997 Mahlmann
5,647,242 A 7/1997 Saunders
D381,913 S 8/1997 Abfier et al.
5,653,357 A 8/1997 Miyazawa et al.
5,678,446 A 10/1997 Futamura et al.
5,689,992 A 11/1997 Saunders et al.
5,718,352 A 2/1998 Diekhoff et al.
5,750,223 A 5/1998 Tada et al.
5,782,375 A 7/1998 McHenry et al.
5,822,843 A 10/1998 Diekhoff et al.
D406,062 S 2/1999 Brewer
5,881,593 A * 3/1999 Bulso, Jr. ..... B21D 22/24 72/336
2,597,240 A 10/1999 Scholl et al.
6,010,026 A 1/2000 Diekhoff et al.
6,010,028 A 1/2000 Jordan et al.
6,032,505 A 3/2000 Stodd
6,095,378 A 8/2000 Potts et al.
6,102,305 A 8/2000 Chapman et al.
6,182,487 B1 2/2001 Komiya et al.
D443,520 S 6/2001 Patricola
6,244,091 B1 6/2001 McClung et al.
6,305,210 B1 * 10/2001 Saunders ..... B21D 22/201 72/348
D453,003 S 1/2002 Rashid
6,463,776 B1 10/2002 Enoki et al.
6,499,329 B1 12/2002 Enoki et al.
6,585,411 B2 7/2003 Hammarth et al.
D481,938 S 11/2003 McRae
D489,987 S 5/2004 Ogata et al.
D489,988 S 5/2004 Ogata et al.
D492,599 S 7/2004 Enoki et al.
6,837,089 B2 1/2005 Jentzsch
6,857,304 B2 2/2005 Enoki
6,929,880 B1 8/2005 Mori et al.
7,191,632 B2 3/2007 Kanehara et al.
7,222,757 B2 5/2007 Ferreira et al.
7,337,646 B2 3/2008 Aoyagi et al.
7,354,234 B2 4/2008 Fujishige et al.
7,497,350 B2 3/2009 Enoki et al.
7,621,166 B2 11/2009 Ferreira et al.
7,654,124 B2 2/2010 Knaup
7,721,578 B2 5/2010 Enoki et al.
7,878,040 B2 2/2011 Taya et al.
7,905,174 B2 3/2011 Vetter et al.
8,439,222 B2 5/2013 McClung et al.
8,713,980 B2 5/2014 Fleischer et al.
8,807,325 B2 8/2014 Olson et al.
9,079,237 B2 7/2015 Fleischer et al.
9,174,262 B2 11/2015 Monro et al.
9,308,570 B2 4/2016 Dunwoody et al.
9,327,333 B2 5/2016 Blue
9,327,899 B2 5/2016 Greenfield et al.
9,328,625 B2 5/2016 Blue
9,334,078 B2 5/2016 Riley et al.
9,387,530 B2 7/2016 Fowler et al.
2004/0173560 A1 9/2004 Chupak
2008/0302799 A1 * 12/2008 Moore ..... B65D 7/04 220/288
2009/0223956 A1 9/2009 Matsukawa et al.
2010/0176224 A1 7/2010 Hasselschwert et al.
2010/0242567 A1 * 9/2010 Nardini ..... B21D 22/24 72/379.4
2012/0043294 A1 2/2012 Dick et al.

(56) References Cited

U.S. PATENT DOCUMENTS

| | | | |
|---|---|---|---|
| 2012/0119725 | A1 | 5/2012 | Noll et al. |
| 2013/0037554 | A1 | 2/2013 | Monro et al. |
| 2013/0098926 | A1 | 4/2013 | Monro et al. |
| 2013/0239644 | A1 | 9/2013 | McClung et al. |
| 2014/0161566 | A1 | 6/2014 | Presset et al. |
| 2014/0298878 | A1 | 10/2014 | Van De Liefvoort |
| 2015/0047407 | A1 | 2/2015 | Monro et al. |
| 2015/0283597 | A1 | 10/2015 | Monro |
| 2016/0107219 | A1 | 4/2016 | Kaanta et al. |
| 2017/0050232 | A1 | 2/2017 | Schremmer et al. |
| 2017/0095852 | A1 | 4/2017 | Carstens et al. |
| 2017/0128999 | A1 | 5/2017 | Butcher et al. |

FOREIGN PATENT DOCUMENTS

| | | |
|---|---|---|
| CA | 2352747 | 4/2001 |
| CN | 101888907 | 11/2010 |
| CN | 102049446 | 5/2011 |
| CN | 102665957 | 9/2012 |
| CN | 103118817 | 5/2013 |
| CN | 103313807 | 9/2013 |
| CN | 103702780 | 4/2014 |
| CN | 104084486 | 10/2014 |
| CN | 106541014 | 3/2017 |
| CN | 304486417 | 2/2018 |
| EP | 0076634 | 4/1983 |
| EP | 0092253 | 10/1983 |
| EP | 326052 | 8/1989 |
| EP | 0404420 | 12/1990 |
| EP | 0412166 | 2/1991 |
| EP | 0457423 | 11/1991 |
| EP | 0505562 | 9/1992 |
| EP | 0536952 | 4/1993 |
| EP | 0667193 | 8/1995 |
| EP | 0684183 | 11/1995 |
| EP | 740971 | 11/1996 |
| EP | 743255 | 11/1996 |
| EP | 1134046 | 9/2001 |
| EP | 1136154 | 9/2001 |
| EP | 1153849 | 11/2001 |
| EP | 0721384 | 12/2002 |
| EP | 1448326 | 8/2004 |
| EP | 1673183 | 6/2006 |
| EP | 1787736 | 5/2007 |
| EP | 2531409 | 5/2016 |
| FR | 2495507 | 6/1982 |
| GB | 1259773 | 1/1972 |
| GB | 1345227 | 1/1974 |
| GB | 1349059 | 3/1974 |
| GB | 2547016 | 8/2017 |
| JP | S59115239 | 7/1984 |
| JP | S61176433 | 8/1986 |
| JP | S61206533 | 9/1986 |
| JP | S63295028 | 12/1988 |
| JP | H03221218 | 9/1991 |
| JP | H04351231 | 12/1992 |
| JP | H0826354 | 1/1996 |
| JP | H0939975 | 2/1997 |
| JP | H10272520 | 10/1998 |
| JP | H11722 | 1/1999 |
| JP | H11105845 | 4/1999 |
| JP | H11164784 | 6/1999 |
| JP | H11169980 | 6/1999 |
| JP | 2000/016416 | 1/2000 |
| JP | 2000/190042 | 7/2000 |
| JP | 2001/038828 | 2/2001 |
| JP | 2002/256366 | 9/2002 |
| RU | 1819173 | 5/1993 |
| WO | WO 95/15259 | 6/1995 |
| WO | WO 96/15865 | 5/1996 |
| WO | WO 98/20992 | 5/1998 |
| WO | WO 98/29206 | 7/1998 |
| WO | WO 01/15829 | 3/2001 |
| WO | WO 2007/052364 | 5/2007 |
| WO | WO 2009/071434 | 6/2009 |
| WO | WO 2011/049775 | 4/2011 |
| WO | WO 2011/053776 | 5/2011 |
| WO | WO 2011/095595 | 8/2011 |
| WO | WO 2011/095613 | 8/2011 |
| WO | WO 2011/113710 | 9/2011 |
| WO | WO 2011/128347 | 10/2011 |
| WO | WO 2011/128385 | 10/2011 |
| WO | WO 2013/017485 | 2/2013 |
| WO | WO 2014/047115 | 3/2014 |
| WO | WO 2014/108489 | 7/2014 |
| WO | WO 2014/110387 | 7/2014 |
| WO | WO 2014/150673 | 9/2014 |
| WO | WO 2014/159215 | 10/2014 |
| WO | WO 2014/170476 | 10/2014 |
| WO | WO 2017/031450 | 2/2017 |
| WO | WO 2017/134413 | 8/2017 |
| WO | WO 2018/067249 | 4/2018 |

OTHER PUBLICATIONS

U.S. Appl. No. 15/453,139, filed Mar. 8, 2017, Lord et al.

International Preliminary Report on Patentability for International (PCT) Patent Application No. PCT/US2015/057799, dated May 11, 2017 8 pages.

Official Action for Australia Patent Application No. 2015339316, dated Nov. 21, 2017 3 pages.

International Search Report and Written Opinion for International (PCT) Patent Application No. PCT/US15/57799, dated May 17, 2016 9 pages.

International Search Report and Written Opinion for International (PCT) Patent Application No. PCT/US15/55715, dated Dec. 31, 2015 13 pages.

Official Action for Canada Patent Application No. 2,964,384, dated Mar. 28, 2018 8 pages.

Official Action with English Translation for China Patent Application No. 201580058458.5, dated Apr. 3, 2018 18 pages.

Extended Search Report for European Patent Application No. 15855504.5, dated Jun. 19, 2018 6 pages.

International Search Report and Written Opinion for International (PCT) Patent Application No. PCT/US2018/021550, dated May 15, 2018 10 pages.

* cited by examiner

APPARATUS AND METHOD FOR FORMING A CUP WITH A REFORMED BOTTOM

CROSS-REFERENCE TO RELATED APPLICATIONS

This application claims priority under 35 U.S.C. § 119(e) to U.S. Provisional Patent Application Ser. No. 62/069,623 filed Oct. 28, 2014, which is incorporated herein in its entirety by reference.

FIELD OF THE INVENTION

The present invention relates generally to the manufacturing of metallic cups from flat sheet material to form container bodies. More specifically, the present invention relates to methods and apparatus for forming metallic cups with reduced height and reformed bottoms having an inwardly oriented projection. The cups are subsequently formed into metallic container bodies, such as aerosol containers.

BACKGROUND

Metallic containers offer distributors and consumers many benefits by providing optimal protection properties for products. For example, metallic containers prevent $CO_2$ migration and block UV radiation which can have a damaging effect on personal care, pharmaceutical, and food products and on other UV-sensitive formulations, negatively influencing the effectiveness of ingredients, as well as the fragrance, appearance, flavor, or color of the product. Metallic containers also offer an impermeable barrier to light, water vapor, oils and fats, oxygen and micro-organisms and keep the contents of the container fresh and protected from external influences, thereby guaranteeing a long shelf-life.

The increased durability of metallic containers compared to glass containers reduces the number of containers damaged during processing and shipping, resulting in further savings. Additionally, metallic containers are lighter than glass containers of comparable size, resulting in energy savings during shipment. Further, metallic containers can be manufactured with high burst pressures which make them ideal and safe for use as containers holding products under pressure, such as aerosol containers. Finally, recycling metallic containers is generally easier than recycling glass and plastic containers because labels and other indicia are printed directly onto the metallic body of the container while glass and plastic containers typically have labels that must be separated during the recycling process.

Metallic containers may include a container body that is formed in a draw and wall ironing (DWI) process separately from a can end. The manufacture of the DWI container body starts by forming a cup from a metallic stock material which is typically shipped and stored in large rolls. Referring to FIG. 1, which depicts the prior art process, a sheet 4 of metallic stock material is fed into a draw-redraw apparatus 2. As shown in FIG. 1A, a blank and draw die 6 cuts a blank 8 from the sheet 4. The blank 8 can have any desired shape. The cut blank 8 is illustrated in FIG. 1A separate from apparatus 2 for clarity. The blank and draw die 6 then draws the blank 8 into a cup 9 with sidewalls 10 and a closed endwall 11 with a first diameter, as illustrated in FIG. 1B. Referring now to FIGS. 1C-1D, optionally a redraw die 12 redraws the cup 9 into a formed cup 13 with a closed endwall 14. As will be appreciated by one of skill in the art, during a redraw operation, the direction of the sidewalls 15 of the cup 14 are reversed. Thus, the open end of the cup 13 faces a direction substantially opposite of the direction of the open end of cup 9. The redraw operation also generally lengthens the sidewalls 15 compared to sidewalls 10 of cup 9, reducing the diameter of the closed endwall 14. Thus, the endwall 14 of the formed cup 13 has a second diameter that is less than the first diameter. The formed cup 13 is then ejected from the apparatus 2 and another portion of the sheet 4 is fed into the apparatus 2, as illustrated in FIG. 1E. In the prior art apparatus 2 illustrated in FIG. 1, the formed cup 13 has a cross-section with generally linear sidewalls 15, as shown in FIG. 1D. The closed endwall 14 is also generally linear. After forming the cup 13, the apparatus 2 ejects the cup in a direction substantially perpendicular to the sheet 4 of stock material. The formed cup 13 is subsequently formed into a container body by a bodymaker by methods known to those of skill in the art. Generally, the size of the container body is directly related to the size of the blank 8 used to form the formed cup 13, i.e., the larger the blank, the more material that is present to form the formed cup 13 and, subsequently, the container body.

To form a taller or wider container body, such as an aerosol container, current manufacturing methods require a blank of a larger size resulting in a formed cup 13 with an increased height. For example, to form a taller or wider container body using the method and apparatus of FIGS. 1A-1E, the height of the sidewall 15 of the formed cup 13 is increased. However, as the height of the formed cup increases, the bodymaker must use a longer punch stroke and longer stroke redraw carriage to form the formed cup 13 into the container body, reducing the speed and efficiency of the bodymaker.

Accordingly, there is an unmet need for a method and apparatus of forming a cup from a blank with a larger size without increasing the height of the cup so that the cup can be reformed into a larger container body without reducing the speed and efficiency of a conventional bodymaker. Further, by utilizing conventional bodymaker tools, equipment costs can be reduced because new tooling is not required in the manufacturing plant. The present invention is particularly useful to manufacture metallic cups which can be utilized in a bodymaker to form aerosol containers.

SUMMARY OF THE INVENTION

The present invention provides novel methods and apparatus for forming a cup with a reformed closed endwall having an inwardly oriented projection for the purpose of reducing the overall height of the cup. After the cup with the reformed closed endwall is formed, the cup may be formed into a container body of any size, shape, or type for any product. One aspect of the present invention is to provide a cup with a reformed closed endwall. The cup generally comprises, but is not limited to, an open end, a sidewall, a closed endwall, and an inwardly oriented protrusion formed in a portion of the closed endwall. In one embodiment of the present invention, the cup has a reduced height compared to a cup of a similar diameter formed from a blank of substantially the same size.

Another aspect of the present invention is to provide a die center punch with a cavity. The die center punch is adapted to support a portion of an interior surface of a cup endwall as an inward projection is formed in the cup.

Still another aspect of the present invention is a reform punch with an extension. The extension is adapted to apply pressure to a portion of an exterior surface of a cup endwall to form an inward projection in the cup.

Another aspect of the present invention is a draw-redraw apparatus operable to form a cup with a reformed closed endwall and a reduced cup height. In one embodiment, the draw-redraw apparatus includes a die center punch, a reform punch, and a reform draw pad. The reform draw pad has a cavity therethrough that aligns with an extension of the reform punch. At least a portion of the extension passes at least partially through the cavity of the reform draw pad and applies a force to a predetermined portion of a bottom surface of the cup. A portion of the bottom of the cup is deformed into a cavity formed at the end of the die center punch, forming an inwardly oriented projection in the bottom of the cup.

In accordance with one aspect of the present invention, a novel method of forming a metallic cup having a sidewall and a reformed bottom is provided. This includes, but is not limited to, a method generally comprising: (1) providing a sheet of stock metal material; (2) shearing the sheet of stock metal material with a tool to form a substantially circular blank with a predetermined size; (3) drawing the blank into a cup with a first diameter by pushing a peripheral edge of the blank downward with a first tool while supporting a center portion of the blank with a second tool, the cup including a closed endwall; (4) reforming the cup by applying pressure to a portion of the closed endwall of the cup to form an inwardly oriented protrusion, the protrusion reducing the interior volume of the cup; and (5) ejecting the metallic cup. In one embodiment, the method may further comprise redrawing the cup with a first diameter to form a cup with a second diameter that is less than the first diameter.

In one embodiment, reforming the cup to form an inwardly oriented protrusion comprises utilizing a die center punch with a cavity formed therein. The inwardly oriented protrusion is formed at least partially within the cavity of the die center punch by applying pressure to an exterior surface of the cup endwall with a reform punch. In one embodiment, the reform punch includes an extension with a generally cylindrical shape. In another embodiment, the extension has a horizontal cross-sectional shape that substantially conforms to a horizontal cross-sectional shape of the cavity of the die center punch.

In one embodiment, the inwardly oriented projection in the bottom portion of the cup formed by the extension of the reform punch has a generally cylindrical shape. In another embodiment, the inwardly oriented projection in the bottom portion of the cup has a shape that is not cylindrical. For example, in one embodiment, the reform punch is generally conically shaped. In yet another embodiment, the reform punch generally has the shape of a frustum.

In one embodiment, reforming the cup to form the inwardly oriented protrusion decreases a height of the cup. A diameter of the cup with the inwardly oriented protrusion is substantially the same as the first diameter of the cup. In another embodiment, the diameter of the metallic cup with the protrusion is at least about 5% less than a diameter of cup of approximately the same height and formed from a blank of approximately the same diameter that does not have an inwardly oriented projection. In still another embodiment, the protrusion reduces the internal volume of the cup by at least about 10%. It will be appreciated that varying the dimensions of the protrusion change internal volume of a cup with a protrusion. Accordingly, in still another embodiment, a cup with a protrusion has an internal volume that is reduced by from about 15% to about 22% compared to the same cup without the protrusion.

In another embodiment, reforming the cup comprises extending an unsupported portion of the closed endwall of the cup. In one embodiment, the second tool that supports the center portion of the blank comprises a reform draw pad with a cavity formed there-through. The reform draw pad is positioned between the reform punch and the die center punch. In one embodiment, the cavity is substantially centered on the reform draw pad. In another embodiment, the cavity of the reform draw pad has a generally circular shape.

In one embodiment, the blank has a generally circular shape, but in another embodiment, the blank has a non-circular shape. In another embodiment, the blank has a shape resembling one of an oval, a square, a rectangle, a triangle, a circle, or any combination thereof.

In one embodiment, the metallic cup has a generally cylindrical shape. In another embodiment, the metallic cup is not cylindrical.

It is another aspect of the present invention to provide a method of forming a metallic cup with an inwardly oriented protrusion. The method generally comprises, but is not limited to: (1) drawing a substantially circular metallic blank into a cup with a first diameter by pushing a peripheral edge of the blank with a first tool while supporting a portion of the blank with a second tool, the cup including a closed endwall and a sidewall; (2) redrawing the cup to form a cup with a second diameter that is less than the first diameter; and (3) reforming the cup by applying pressure to a portion of the closed endwall to form a protrusion within an interior of the cup, the protrusion reducing a length of the cup sidewall.

In one embodiment, reforming the cup to form the protrusion does not substantially change the second diameter of the cup. In another embodiment, reforming the cup comprises extending an unsupported portion of the closed endwall of the cup into a cavity of a die center punch positioned within the interior of the cup. In still another embodiment, a reform punch applies pressure to an unsupported bottom surface portion of the closed endwall of the cup during the reforming. In one embodiment, a reform draw pad is positioned between the reform punch and the closed endwall of the cup during the reforming. The reform draw pad includes a cavity to receive at least a portion of the punch.

In accordance with another aspect of the present invention, an improved apparatus for forming a metallic cup having a conical shaped bottom portion with an inwardly extending projection from a cup with a substantially flat bottom portion is disclosed. The improvement generally comprises, but is not limited to: (1) providing a metallic cup with a substantially flat bottom portion and a sidewall; (2) a first tool to support an interior surface of the bottom portion of the metallic cup proximate to at least the sidewall; and (3) a second opposing tool to apply pressure to an exterior surface of the bottom portion of the metallic cup opposite of the first tool, the second tool comprising a projection which travels at least partially into a cavity formed in the first tool to form an inwardly oriented projection in the cup bottom portion.

In one embodiment, the first tool comprises a die center punch with the cavity formed therein. In another embodiment, the second tool comprises a reform punch with an upwardly extending projection.

In one embodiment, a reform draw pad with a substantially centered cavity is positioned between the first tool and the second tool as the inwardly oriented projection is formed. In another embodiment, the sidewall of the metallic cup is supported by a third tool as the inwardly oriented projection is formed.

In one embodiment, the cavity of the reform draw pad has a shape that is generally round, oval, square, rectangular, triangular, or any combination thereof. In one embodiment, the extension of the reform punch has a shape that is generally spherical, conical, cylindrical, rectangular, triangular, a frustum, or any combination thereof.

The above-described embodiments, objectives, and configurations are neither complete nor exhaustive. As will be appreciated, other embodiments of the invention are possible using, alone or in combination, one or more of the features set forth above or described in detail below.

As will be appreciated by one of skill in the art, the method and apparatus of the current invention may be used to form cups of any material used to form metallic containers, including without limitation aluminum, tin, steel, and combinations thereof. Further, the method and apparatus of the current invention may be used to form cups that are subsequently formed into container bodies or vessels of any size and shape and for storing any type of product for any industry. Accordingly, cups formed by the method and apparatus of the present invention may be formed into containers or vessels used to store or contain liquids and gases of all types, including consumer products and beverages as well as industrial chemicals and products.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended, nor should it be construed, as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF DRAWINGS

The accompanying drawings, which are incorporated herein and constitute a part of the specification, illustrate embodiments of the invention and together with the Summary of the Invention given above and the Detailed Description of the drawings given below serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figures 1A, 1B, 1C, 1D, 1E:
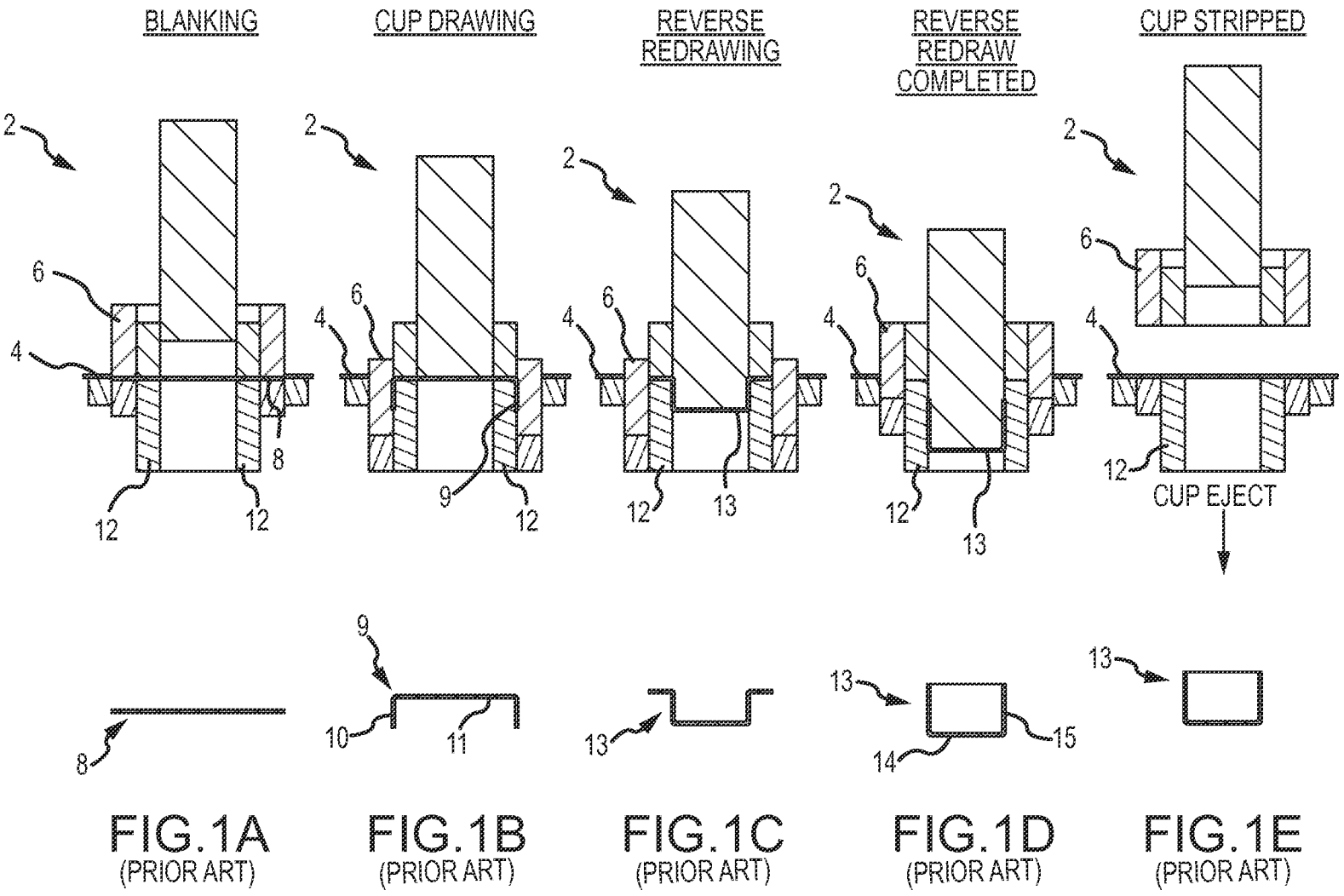
FIG.1A (PRIOR ART)
FIG.1B (PRIOR ART)
FIG.1C (PRIOR ART)
FIG.1D (PRIOR ART)
FIG.1E (PRIOR ART)
FIGS. 1A-1E depict a prior art method and apparatus used to form a metallic cup.

Similar components and/or features may have the same reference number. Components of the same type may be distinguished by a letter following the reference number. If only the reference number is used, the description is applicable to any one of the similar components having the same reference number.

To assist in the understanding of one embodiment of the present invention the following list of components and associated numbering found in the drawings is provided herein:

| Number | Component |
|---|---|
| 2 | Draw-redraw apparatus; |
| 4 | Sheet of metallic stock material |
| 6 | Blank and draw die |
| 8 | Blank |
| 9 | Cup |
| 10 | Sidewalls |
| 11 | Closed endwall |
| 12 | Redraw die |
| 13 | Formed cup |
| 14 | Closed endwall |
| 15 | Sidewall |
| 16 | Draw-redraw apparatus |
| 18 | Blanking die |
| 20 | Cut edge |
| 22 | Blank and draw die |
| 24 | Draw pressure pad |
| 26 | Redraw pressure pad |
| 28 | Redraw die |
| 29 | Void between blank and draw die and redraw die |
| 30 | Die center punch |
| 31 | Cavity of die center punch |
| 32 | Reform draw pad |
| 33 | Cavity of reform draw pad |
| 34 | Reform punch |
| 35 | Extension of reform punch |
| 36 | Leading surface of blank and draw die |
| 37 | Leading edge |
| 38 | Blank |
| 40 | Cup |

-continued

| Number | Component |
|---|---|
| 41 | Closed endwall |
| 42 | Redrawn cup |
| 43 | Sidewalls |
| 44 | Projection |
| 45 | Open end |
| 46 | Finished cup with reformed closed endwall |
| 48 | Diameter of blank |
| 50 | First sidewall height |
| 52 | First diameter of endwall |
| 54 | Second sidewall height |
| 56 | Second diameter of endwall |
| 58 | Third sidewall height |
| 60 | Third diameter of endwall |
| 62 | Projection height |
| 64 | Projection diameter |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Referring now to FIGS. 2A-2F, a draw-redraw apparatus 16 with a novel die set of one embodiment of the present invention is provided. The apparatus 16 generally comprises a blank die 18 with a cut edge 20, a blank and draw die 22, a draw pressure pad 24, a redraw pressure pad 26, a redraw die 28, a die center punch 30, a reform draw pad 32, and a reform punch 34. The apparatus 16 is operable to form a plurality of cups from a sheet 4 of metallic stock material through a draw and wall ironing (DWI) process. Optionally, the apparatus 16 may redraw the cups. The finished cups 46 are formed from a blank 38 with an increased diameter 48 and have an inwardly oriented projection 44 in a closed endwall portion that reduces a height of the cup compared to cups formed from a similar sized blank using the prior art process illustrated in FIG. 1. Other forming operations may subsequently be used to form the cups into container bodies of any shape for any variety of products, including aerosol cans.

Figure 2B:
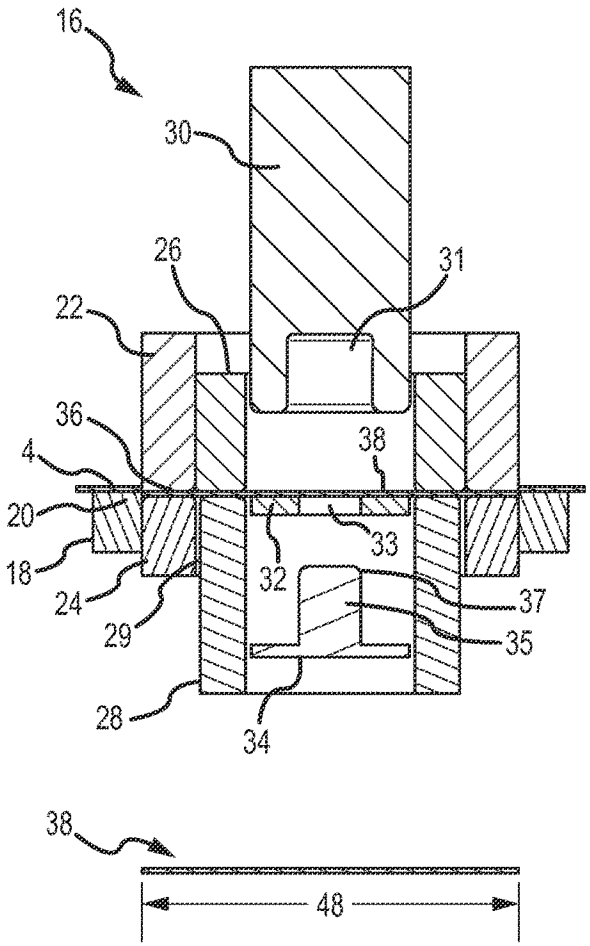
FIGS. 2A-2F depict a method and apparatus for forming a cup with an inwardly oriented projection in a closed endwall portion with a draw-redraw apparatus according to one embodiment of the present invention as well as a cup with an inward projected formed by the apparatus.
Figure 2A:
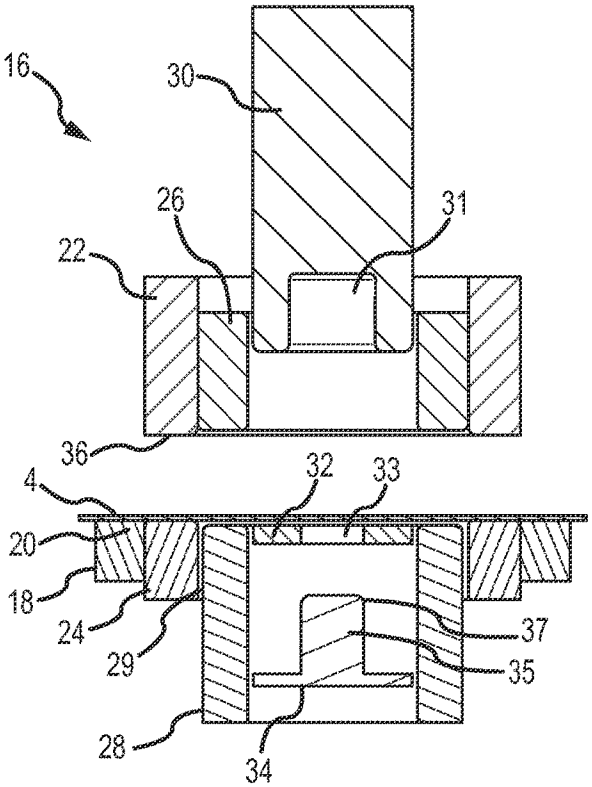

As illustrated in FIG. 2A, a sheet 4 of metallic stock material is fed into the apparatus 16. The blank and draw die 22 is then moved in a first direction toward the blanking die 18 and the draw pressure pad 24 until a leading surface 36 of the blank and draw die 22 contacts and applies pressure to an upper surface of the sheet 4. The sheet 4 is forced against the cut edge 20 of the blanking die 18, as illustrated in FIG. 2B. The sheet 4 is sheared to form a blank 38 of a predetermined size and shape. The blank 38 is also illustrated in FIG. 2B separated from the apparatus 16 for clarity. In one embodiment, the blank 38 has a generally circular shape with a predetermined diameter 48 of between about 5 inches and about 10 inches, and in some embodiments the diameter is more preferably between about 7 inches and about 8 inches. In other embodiments the blank diameter is between about 6.75 inches and about 8.25 inches to form smaller sized cups. However, it will be appreciated by those of skill in the art that the blank 38 can have any desired diameter depending upon the desired size of the finished container. Further, the blank may have any shape, including oval, square, rectangular, triangular, circular, and/or combinations thereof.

In conjunction with the movement of the blank and draw die 22 and the draw pressure pad 24, the redraw pressure pad 26 and the die center punch 30 are moved towards the redraw die 28. The bottom surface of the blank 38 is then contacted with the redraw die 28. The peripheral edge of the blank 38 is pushed in the first direction while a center portion of the blank is supported. The blank 38 is deformed, or drawn, under pressure and conforms to an interior surface of a hollow interior of the blank and draw die 22 forming a cup 40 with a predetermined, generally cylindrical shape. In an alternative embodiment a projection 44 may be formed in the cup at this stage or later as described below. The cup 40 generally includes an open end 45, sidewalls 43 with a first height 50 and a closed endwall 41 with a first diameter 52, as illustrated in FIG. 2C. In one embodiment, the cup 40 has a generally cylindrical shape, although as will be appreciated by those of skill in the art, the cup 40 can have any desired shape, including a non-cylindrical shape. An exterior surface of the redraw die 28, which comprises a smaller outer diameter than the internal diameter of the hollow interior of the blank and draw die 22, is nested within the hollow interior of the blank and draw die 22. As the blank 38 is deformed, the blank 38 transitions out of a space between the blank and draw die 22 and the draw pressure pad 24.

Figure 2D:
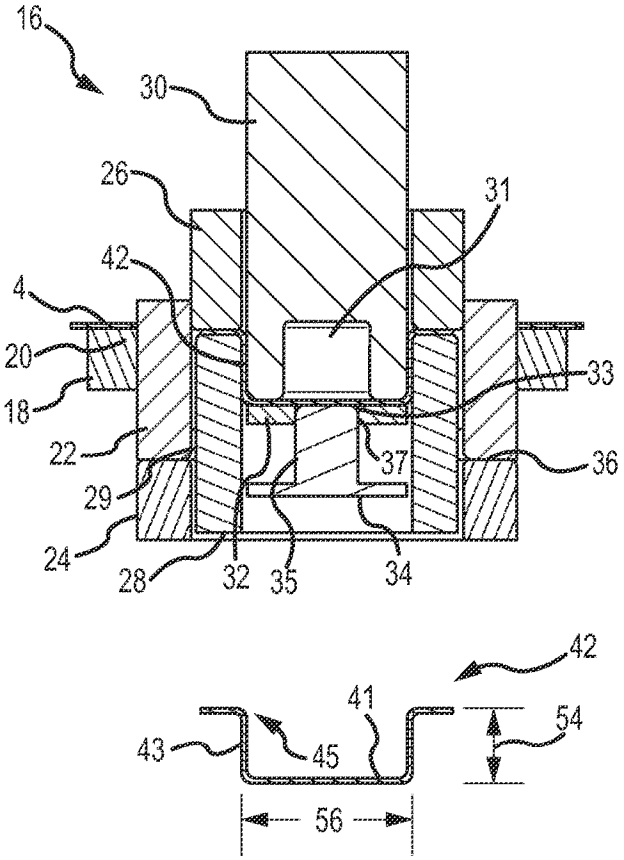
Figure 2C:
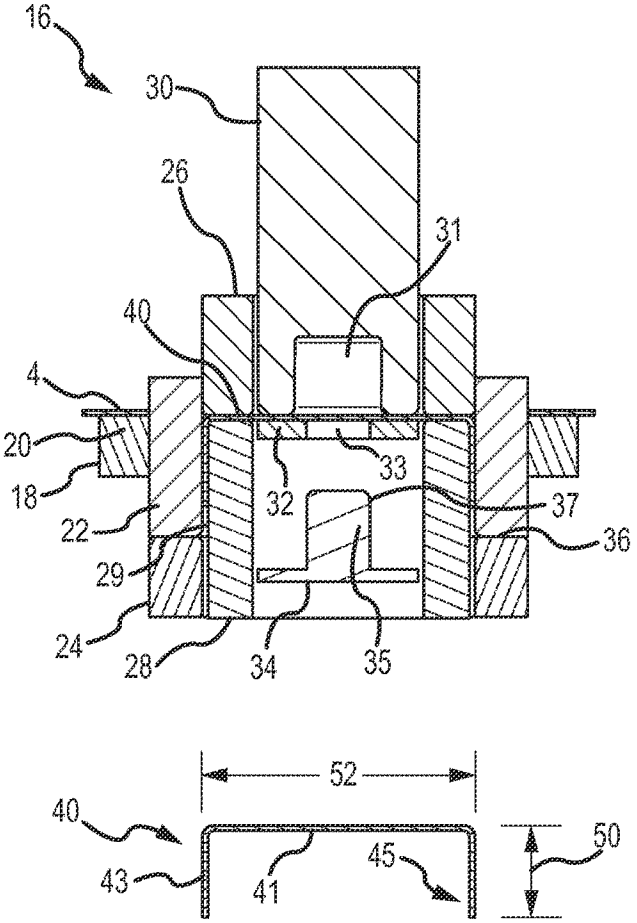

Referring now to FIG. 2D, a portion of an upper surface of the cup 40 is contacted with the die center punch 30. Optionally, the cup 40 may be reformed (or partially redrawn) to form a redrawn cup 42 as the die center punch 30 continues to move in the first direction, conforming a portion of the cup 40 to the interior shape of the redraw die 28 under pressure. As illustrated in FIG. 2D, the material of the cup 40 is translated out from a space 29 between the blank and draw die 22 and the redraw die 28. While the cup is redrawn, the cup 40 also transitions out of a space between the redraw pressure pad 26 and the redraw die 28. The redrawn cup 42 in FIG. 2D has a closed endwall 41 with a second diameter 56 that is less than the endwall diameter 52 of the cup 40 shown in FIG. 2C. In one embodiment, the redrawn cup 42 has a diameter of between about 2.5 inches and about 5.0 inches and in another embodiment between about 3.5 inches and about 4.25 inches. For smaller cups, the diameter of the redrawn cup is between about 2.75 inches and 3.50 inches. The redrawn cup 42 illustrated in FIG. 2D has sidewalls 43 with a height 54 that may be the same as, or different from, the height 50 of the sidewalls 43 of cup 40. As will be appreciated by one of skill in the art, the cup 40 may be reformed any number of times, including zero times. Each time the cup is reformed, the diameter of the closed endwall is decrease by a predetermined amount.

A closed endwall portion of the reformed redrawn cup 42 contacts the reform draw pad 32 and moves the reform draw pad 32 in the first direction toward the reform punch 34 as the die center punch 30 continues moving in the first direction forming the optional redrawn cup 42. An extension 35 of the reform punch 34 aligns substantially concentrically with a cavity 33 formed through the reform draw pad 32. In one embodiment, the extension 35 has a generally cylindrical shape with a tapered or rounded upper edge 37. However, it will be appreciated by those of skill in the art that the extension 35 can have any desired shape. In one embodiment, the extension has a cross-section with a round shape, an oval shape, a square shape, a rectangular shape, a triangular shape, a frustum, and/or combinations thereof. The cavity 33 of the reform draw pad 32 has a shape adapted to at least partially receive the extension 35 of the reform punch 34. In one embodiment, the cavity 33 has a generally circular shape with an interior diameter of between about 2.0 inches and about 2.75 inches, and more preferably between about 1.5 inches and about 3.0 inches, which is greater than an exterior diameter of the extension 35. Thus, the interior diameter of the cavity 33 is between about 40% and about 75% of the diameter of the draw pad 32, and in other embodiments between about 50% and about 65% of the diameter of the cavity 33. As will be appreciated by those of skill in the art, the cavity 33 can have any desired shape adapted to at least partially receive the extension 35. In one embodiment, the cavity 33 is substantially centered on the reform draw pad 32. In another embodiment, the cavity has a shape that is different than the cross-sectional shape of the extension.

Figure 2F:
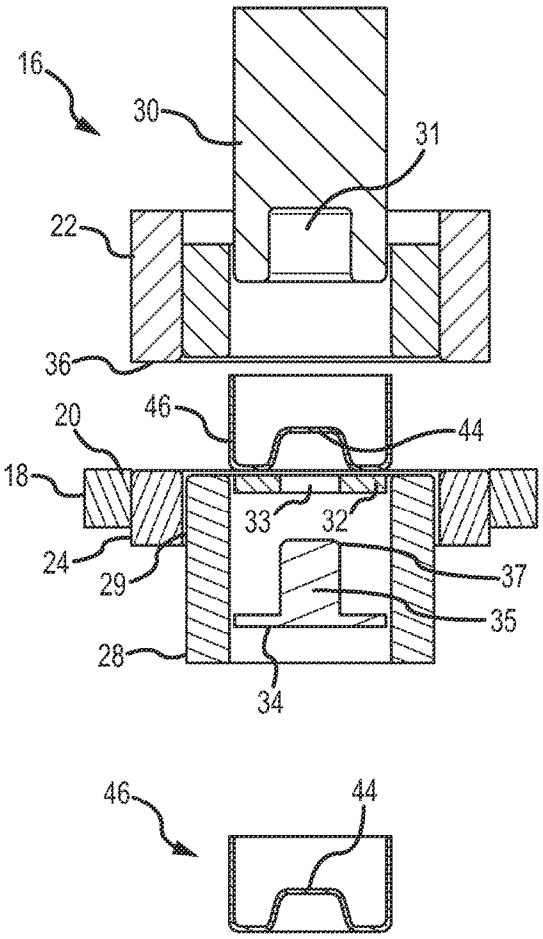
Figure 2E:
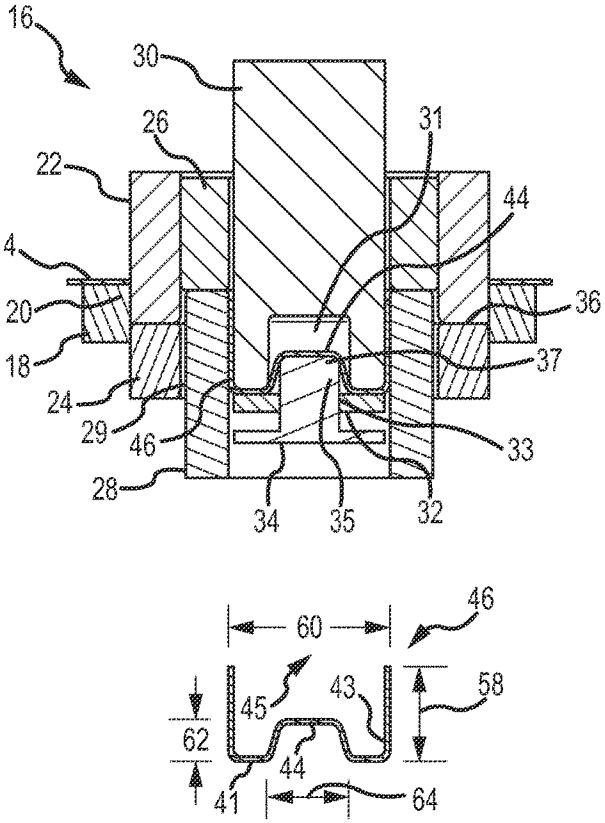

Referring now to FIG. 2E, as the die center punch 30 continues to move in the first direction to form the redrawn cup 42, the reform draw pad 32 also continues to move in the first direction. The extension 35 of the reform punch 34 projects at least partially through the cavity 33 and contacts the closed endwall portion 41 of the redrawn cup 42. The extension 35 applies force to the closed endwall 41 and reforms the closed endwall, displacing the closed endwall at least partially into a cavity 31 of the die center punch 30. The cavity 31 is adapted to at least partially receive the extension 35 and a portion of the closed endwall of the redrawn cup 42. In one embodiment, the cavity 31 has a generally cylindrical shape and is substantially concentrically aligned with the cavity 33 of the reform draw pad 32. The cavity 31 has a diameter that is at least equal to the exterior diameter of the punch extension 35. Thus, the extension 35 pushes against an unsupported portion of the closed endwall 41 of the cup 42. As the extension 35 pushes against an exterior surface of the endwall, a portion of the interior surface of the closed endwall is supported.

In one embodiment, the cavity 31 has an interior diameter that is at least equal to the interior diameter of the cavity 33 of the reform draw pad 32. In one embodiment the cavity 31 has a diameter of between about 1.5 inches and about 3.0 inches, and alternatively between about 2.0 inches and about 2.75 inches. As the extension 35 applies force to the closed endwall portion of the redrawn cup 42, the closed endwall portion of the redrawn cup 42 is reformed and an inwardly oriented projection 44 is formed in a portion of the closed endwall 41 of the finished cup 46. Although the inwardly oriented projection 44 is illustrated being formed on a redrawn cup 42, it will be appreciated that an inwardly oriented projection 44 can also be formed in a cup 40 that has not been reformed using the method and apparatus of the present invention.

The finished cup 46 illustrated in FIG. 2E has a closed endwall 41 with a predetermined diameter 60 of between about 2.5 inches and about 5.0 inches and preferably between about 3.5 inches and about 4.25 inches. In one embodiment, the diameter 60 is substantially the same as the redrawn cup 42 diameter 56 illustrated in FIG. 2D. The cup 46 has sidewalls 43 with a predetermined height 58 of between about 2.0 inches and about 5.0 inches and more preferably between about 2.5 inches and about 4.5 inches. The projection 44 has a predetermined height 62 of between about 0.25 inches and about 1.5 inches and more preferably between about 0.5 inches and about 1.25 inches. A diameter 64 of the projection 44 is between about 1.5 inches and about 3.0 inches. In a more preferred embodiment, the diameter is between about 2.0 inches and about 2.75 inches. The inwardly oriented projection 44 can have any desired size or shape. In one embodiment, the projection 44 has a cross-section of a truncated cone, or frustum, with a first diameter 64 proximate to the closed endwall surface 41 of the finished cup 46 that is greater than a second diameter at a top of the projection 44. In another embodiment, the projection has a generally cylindrical shape with a substantially constant diameter. Thus, the volume of the cup 40 shown in FIG. 2C when compared to the cup 46 shown in FIG. 2E is reduced by between about 15% and about 50%. More preferably, the internal volume is reduced by between about 20% and about 45%. Of course, as will be appreciated, the size (or volume) of the projection 44 may be altered. Accordingly, the internal volume of the cup 46 may change. In one embodiment, the internal volume of cup 40 is reduced by between about 5% and about 15% when the projection 44 is formed to create cup 46. In a more preferred embodiment, the internal volume of cup 46 is about 10% less than cup 40. In another embodiment, the internal volume of cup 46 is at least 7% less than cup 40.

After forming the projection 44, the tooling is separated and/or extracted, and the finished cup 46 with the reformed bottom is ejected as illustrated in FIG. 2F. In one embodiment, the die center punch 30, reform draw pad 32, and the redraw pressure pad 26 each move in the second direction toward their starting positions illustrated in FIG. 2A. As the reform draw pad 32 moves in the second direction, the finished cup 46 moves out of the redraw die 28 until the bottom surface of the finished cup 46 is substantially level with the upper surface of the blanking die 18. The finished cup 46 is then ejected from the apparatus 16 and another portion of the sheet 4 of metallic stock material is fed into the apparatus 16, as illustrated in FIG. 2A. In one embodiment, the finished cup 46 is ejected laterally from the apparatus 16.

Figure 3B:
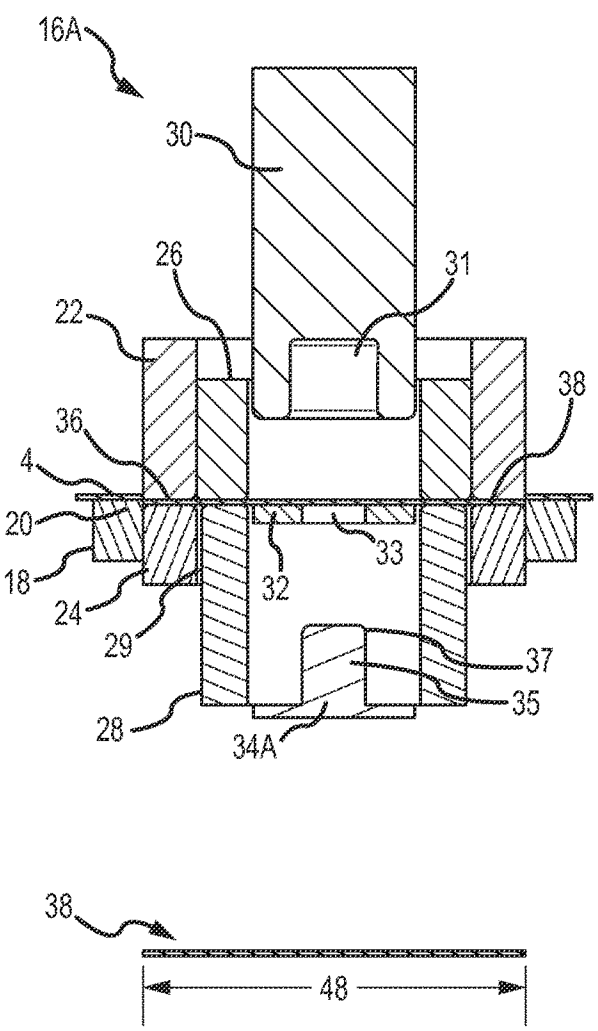
FIGS. 3A-3F depict a method and apparatus for forming a cup with an inwardly oriented projection in a closed endwall portion with a draw-redraw apparatus according to another embodiment of the present invention as well as a cup with an inward projected formed by the apparatus.
Figure 3A:
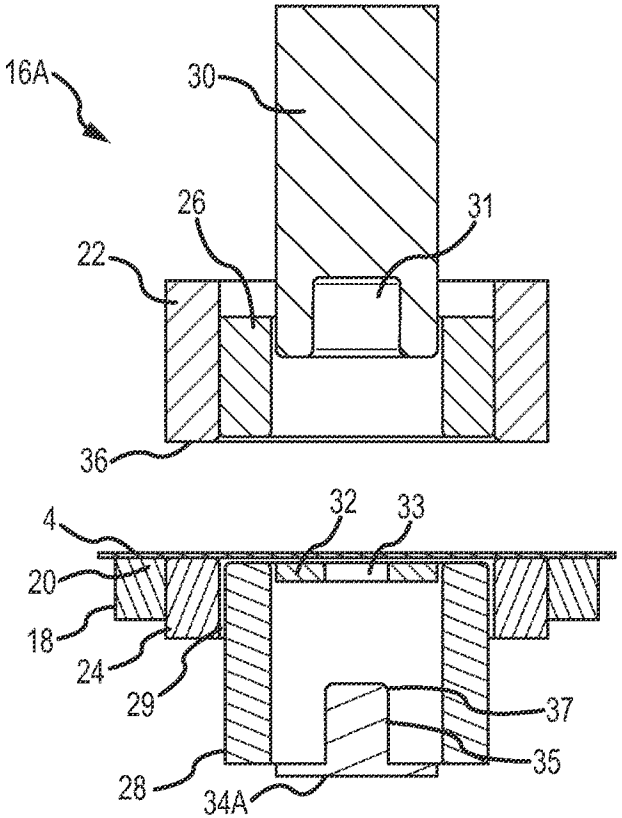
Figure 3D:
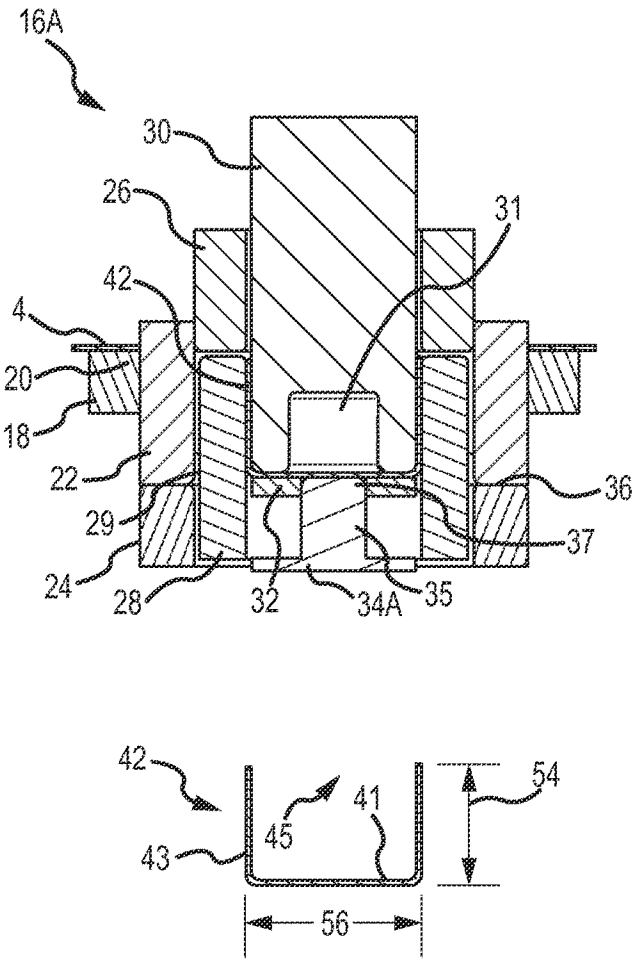

Referring now to FIGS. 3A-3F, a draw-redraw apparatus 16A according to another embodiment of the present invention is provided herein. Apparatus 16A is used to form a finished cup 46 with an inwardly oriented projection 44 in a number of sequential steps in a manner similar to the method illustrated in FIGS. 2A-2F. In apparatus 16A, a reform punch 34A is positioned further from the sheet 4 of metallic stock material with respect to the redraw die 28 compared to the position of the reform punch 34 of the embodiment of the present invention described in conjunction with FIG. 2. Thus, the optional redraw of the cup 40 to form the redrawn cup 42, illustrated in FIG. 3D, is substantially completed before the reform punch 34A reforms the closed endwall portion of the redrawn cup 42, illustrated in FIG. 3E. In one embodiment, the reform punch 34A has substantially the same size and shape as reform punch 34A.

Referring now to FIG. 3A, a sheet 4 of metallic stock material is fed into the apparatus 16A. A blank 38 with diameter 48 is sheared from the sheet 4 as illustrated in FIG. 3B. The blank 38 illustrated in FIG. 3B may be the same as, or similar to, blank 38 illustrated in FIG. 2B. Similarly, the diameter 48 may have the same, or similar, dimensions as discussed above in conjunction with FIG. 2B.

Figure 3C:
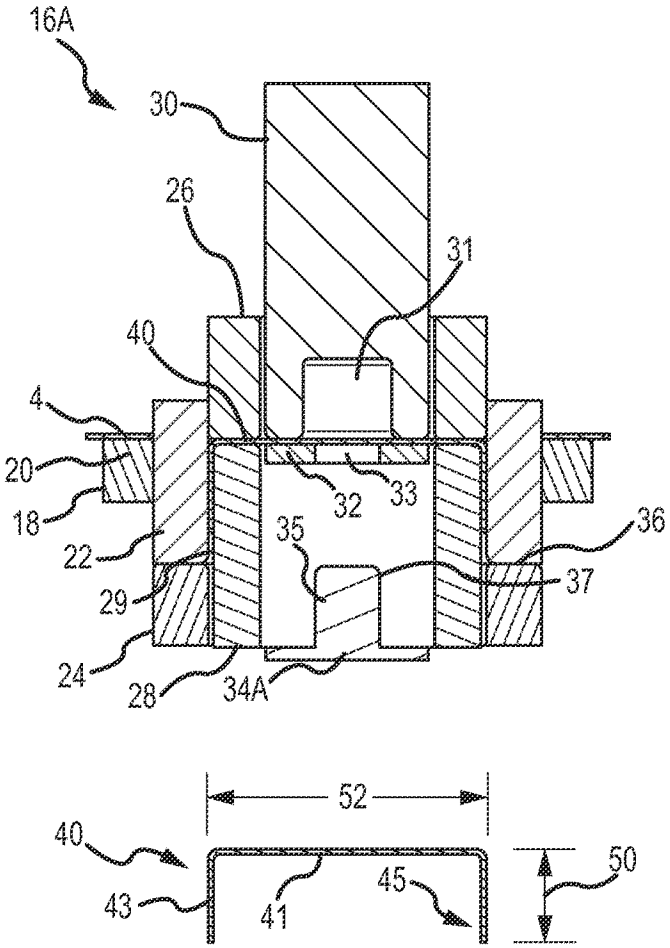

Referring now to FIG. 3C, the apparatus 16A forms the blank 38 into a cup 40 with a predetermined shape. The cup 40 may have the same shape, endwall diameter 52, and sidewall height 50 as the cup 40 illustrated in FIG. 2C. Optionally, the cup 40 is redrawn to form a redrawn cup 42, as illustrated in FIG. 3D. The redrawn cup 42 illustrated in FIG. 3D may have the same endwall diameter 56 as the redrawn cup 42 illustrated in FIG. 2D. However, in this embodiment of the present invention, the sidewalls 43 are substantially completely re-drawn before the closed endwall 41 is reformed. Accordingly, the redrawn cup 42 illustrated in FIG. 3D has sidewalls with a generally linear cross-sectional height 54 which is distinct from the shape and size of the sidewalls of the cup 42 of the embodiment illustrated in FIG. 2D. In one embodiment, the height 54 of cup 42 illustrated in FIG. 3D is between about 2.0 inches and about 4.5 inches. More preferably, the height 54 is between about 2.5 inches and about 3.75 inches. As will be appreciated by one of skill in the art, in one embodiment, the cup 42 shown in FIG. 3D may be ejected from the apparatus 16A and used to form a container. Thus, in one embodiment, the cup 42 shown in FIG. 3D may be used to form a container with a predetermined shape and size without forming a projection in the closed end-wall of the cup.

Figure 3F:
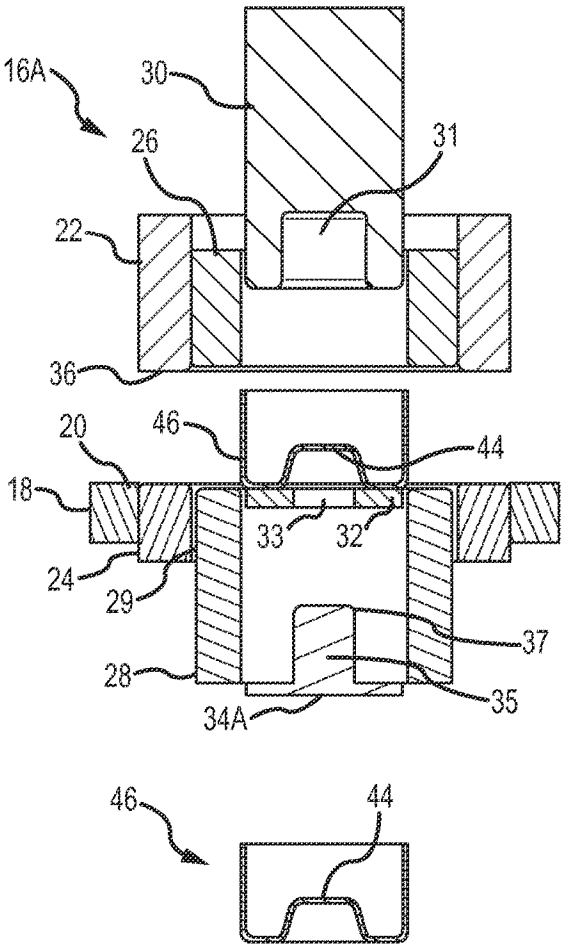
Figure 3E:
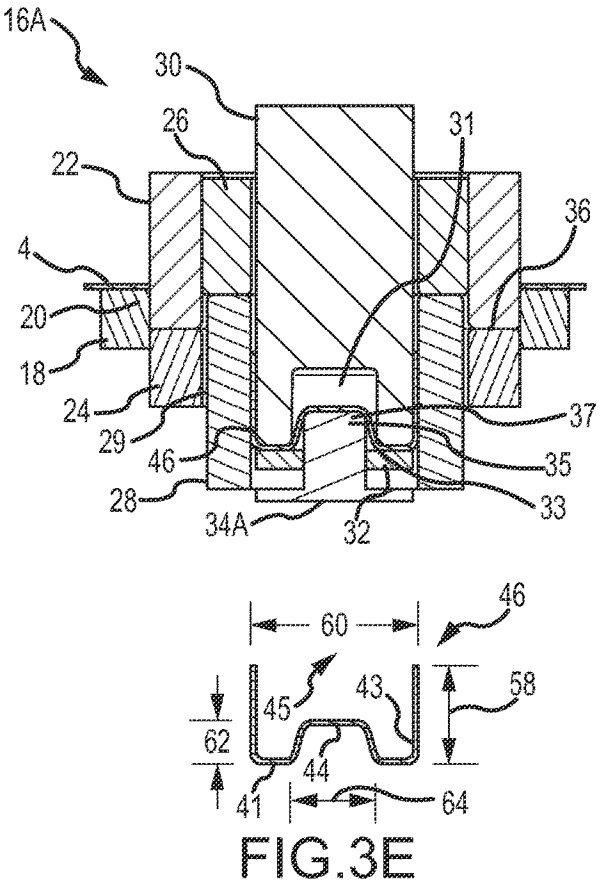

The closed endwall 41 of the redrawn cup 42 is reformed by the reform punch 34A to form a finished cup 46 with a reformed closed endwall comprising an inwardly oriented projection 44, as illustrated in FIG. 3E. The height 58 of the cup 46 is less than the height 54 of cup 42 illustrated in FIG. 3D after forming the inwardly oriented projection 44. Thus, the total internal volume, or the overflow volume, of cup 42 is reduced. More specifically, the volume of the cup 46 shown in FIG. 3E is reduced with respect to the volume of the cup 42 shown in FIG. 3D by between about 5% to about 40%. In a more preferred embodiment, the volume of cup 46 is between about 10% and about 30% less than the internal volume of cup 42 illustrated in FIG. 3D. In another embodiment, the volume of cup 46 is between about 15% and about 21% less than the internal volume of cup 42 shown in FIG. 3D. In a still more preferred embodiment, the cup 46 has a volume that is about 18% less than the volume of cup 42 of FIG. 3D. As will be appreciated by one of skill in the art, changing the size or shape of the projection 44 changes the relative volumes of cups 42 and 46. Thus, in still another embodiment of the present invention, the volume of cup 42 of FIG. 3D is reduced by at least 10% when the projection 44 is formed to make cup 46. The cup 46 and projection 44 illustrated in FIG. 3E may generally have the same shape and dimensions as the cup 46 projection 44 illustrated and described in conjunction with FIG. 2E, above. Thus, in one embodiment, the cup 46 has the same endwall diameter 60, sidewall height 58, projection diameter 64, and projection height 62 as the cup 46 of the embodiment of the present invention illustrated in FIG. 2E.

Referring now to FIG. 3F, the finished cup 46 is ejected from the apparatus 16A. In one embodiment, the finished cup 46 is ejected laterally from the apparatus 16. The finished cup 46 is subsequently formed into a container body by a bodymaker by any method known to those of skill in the art.

In various embodiments, pneumatic compressed air or other means provides force to one or more of the tooling components of the draw-redraw apparatus 16 described herein. For example, in one embodiment, a tooling component, such as the redraw pressure pad 26 is provided with an "inner" air pressure which applies a clamping force as shown in FIGS. 2B-2D and 3B-3D and another tooling component, such as the draw pressure pad 24, is supplied with an "outer" air pressure, which is illustrated as a clamp force in FIGS. 2B and 3B.

By reforming the closed endwall portion 41 of the finished cup 46 with the projection 44, the height 58 of the finished cup 46 is decreased compared to the height of the cup 13 formed by the prior art method. Accordingly, existing tooling and bodymakers can be used to form cups 46 into container bodies that are larger. In this manner, container bodies with an increased height and/or an increased diameter can be formed. The finished cup 46 has a height 58 that is less than the height of the formed cup 13 formed using the prior art method and apparatus, although the diameter 48 of the blanks 8, 38 used to form cups 13, 46 are substantially equal.

Further, reforming the closed endwall portion of the finished cup 46 enables a shorter bodymaker ram stroke and a shorter stroke redraw carriage to be used when forming the container body. Thus, the bodymaker can operate at a higher speed than is possible when forming a container body from a cup 13 without the reformed closed endwall having the inwardly oriented projection. As will be appreciated by one of skill in the art, the maximum amount that the diameter of a cup can be reduced by a bodymaker in a subsequent redraw step is known as a "draw ratio." By forming an inwardly oriented projection 44 on a closed endwall portion of a finished cup 46 with a diameter corresponding to the draw ratio of a bodymaker, the amount of the material in the finished cup 46 can be increased while the height 58 of the finished cup 46 is shortened. Thus, the finished cup 46 can be formed into a container body by a conventional bodymaker.

A further advantage of reforming the closed endwall portion 41 of the finished cup 46 is that the finished cup 46 of a predetermined blank size and maximum height may be formed with a smaller transverse dimension of a longitudinal cross section than would otherwise be possible. For example, a cylindrical cup with reformed closed endwall and specified maximum height may have a smaller diameter than a cylindrical cup of the same height made from a blank of the same size. In one embodiment of the present invention, the diameter 60 of a finished cup 46 with a cylindrical shape having a reformed closed endwall is approximately 5% less than that of a cylindrical cup 13 of the same height without an inwardly oriented projection 44, although both cups 13, 46 are formed from substantially the same size blank 8, 38. This reduction in the transverse dimension of the finished cup 46 facilitates the redraw operation in the bodymaker. The redraw operation in the bodymaker must reduce the internal diameter of the cylindrical cup to the diameter of the finished container body. Reduction of the cup diameter to the finished container body diameter is most reliably accomplished when the reduction in the diameter of the cup is small. If the attempted diameter reduction is too large, the redraw operation will fail by any of several means, including wrinkling or rupture of the cup material. In one embodiment, the reduction in diameter from cup diameter to container body diameter, as compared to the cup diameter, is limited to not more than 40%. In another embodiment, the reduction is limited to not more than 35%.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. An apparatus for forming a reformed metallic cup having a bottom portion with an inwardly oriented projection from a metallic cup with a substantially flat bottom portion, the improvement comprising:

providing the metallic cup with the substantially flat bottom portion and a sidewall;

a die center punch to support an interior surface of the substantially flat bottom portion of the metallic cup proximate to at least the sidewall, the die center punch having a cavity with a depth at least equal to a height of the inwardly oriented projection;

a reform draw pad with a substantially centered cavity; and a reform punch opposing the die center punch to apply a force to an exterior surface of the substantially flat bottom portion of the metallic cup opposite of the die center punch, said reform punch comprising an extension which travels through the substantially centered cavity of the reform draw pad and into the cavity of said die center punch to form the inwardly oriented projection, wherein a height of the inwardly oriented projection is at least about 5 percent of a height of a sidewall of the reformed metallic cup, and wherein the reform draw pad is configured to move from a first position in which the extension of said reform punch does not extend into the substantially centered cavity of the reform draw pad to a second position in which the reform punch extension extends through the substantially centered cavity of the reform draw pad, wherein the sidewall of the metallic cup with the substantially flat bottom portion is supported by an interior surface of a redraw die as the inwardly oriented projection is formed, and wherein the height of the sidewall of the reformed metallic cup with the inwardly oriented projection is between about 60 percent and about 97 percent of a height of the sidewall of the metallic cup with the substantially flat bottom portion.

2. The apparatus of claim 1, wherein the cavity of the die center punch has a diameter of between about 1.5 inches and about 3.0 inches.

3. The apparatus of claim 1, wherein the extension of the reform punch has a generally cylindrical shape with a rounded upper edge portion and an endwall that is generally planar.

4. The apparatus of claim 1, wherein an interior diameter of the cavity of the die center punch is at least equal to an interior diameter of the substantially centered cavity of the reform draw pad.

5. The apparatus of claim 1, wherein the reformed metallic cup is subsequently formed into a container body by a container bodymaker.

* * * * *